US006060719A

United States Patent [19]

DiTucci et al.

[11] Patent Number: 6,060,719

[45] Date of Patent: May 9, 2000

[54] FAIL SAFE GAS FURNACE OPTICAL FLAME SENSOR USING A TRANSCONDUCTANCE AMPLIFIER AND LOW PHOTODIODE CURRENT

[75] Inventors: Joseph DiTucci, Simsbury, Conn.; Stephen K. Phelps, Chillicothe, Ill.; Martin F. Zabielski, Manchester, Conn.

[73] Assignee: Gas Research Institute, Chicago, Ill.

[21] Appl. No.: 08/881,330

[22] Filed: Jun. 24, 1997

[51] Int. Cl.[7] ..... G02B 27/00

[52] U.S. Cl. ..... 250/554; 431/79

[58] Field of Search ..... 250/554, 574, 250/214 R; 431/79, 78, 75; 340/577, 578

[56] References Cited

U.S. PATENT DOCUMENTS

| | | | |
|---|---|---|---|
| 3,689,773 | 9/1972 | Wheeler . | |
| 3,692,415 | 9/1972 | Shiller . | |
| 3,967,255 | 6/1976 | Oliver et al. . | |
| 4,039,844 | 8/1977 | MacDonald | 250/554 |
| 4,059,385 | 11/1977 | Gulitz et al. | 431/79 |
| 4,163,903 | 8/1979 | Robertson | 250/554 |
| 4,226,533 | 10/1980 | Snowman | 356/338 |
| 4,322,723 | 3/1982 | Chase | 340/578 |
| 4,328,488 | 5/1982 | Yanai et al. | 340/578 |
| 4,391,517 | 7/1983 | Zucker et al. | 356/73.1 |
| 4,398,570 | 8/1983 | Suzuki et al. . | |
| 4,425,788 | 1/1984 | Franke et al. . | |
| 4,481,506 | 11/1984 | Honma . | |
| 4,533,834 | 8/1985 | McCormack | 250/554 |
| 4,540,886 | 9/1985 | Bryant | 250/554 |
| 4,555,800 | 11/1985 | Nishikawa et al. | 382/25 |
| 4,568,926 | 2/1986 | Malinowski | 250/574 |
| 4,616,137 | 10/1986 | Goff et al. | 250/554 |
| 4,653,998 | 3/1987 | Sohma et al. | 431/79 |
| 4,695,734 | 9/1987 | Honma et al. | 250/573 |
| 4,778,378 | 10/1988 | Dolnick et al. | 431/79 |
| 4,904,986 | 2/1990 | Pinckaers | 340/578 |
| 4,906,178 | 3/1990 | Goldstein et al. | 431/79 |
| 4,913,647 | 4/1990 | Bonne et al. | 431/79 |
| 5,222,887 | 6/1993 | Zabielski, Sr. | 431/12 |
| 5,264,708 | 11/1993 | Hijikata | 250/554 |
| 5,420,440 | 5/1995 | Ketler et al. | 250/573 |
| 5,472,336 | 12/1995 | Adams et al. | 431/6 |
| 5,506,569 | 4/1996 | Rowlette | 340/577 |
| 5,691,700 | 11/1997 | Phelps et al. | 340/600 |

*Primary Examiner*—Que T. Le
*Attorney, Agent, or Firm*—Pauley Peterson Kinne & Fejer

[57] ABSTRACT

A fail safe gas furnace optical flame sensor uses a transconductance amplifier with low photodiode current to sense the presence or absence of a gas flame within the burner of a gas furnace. The photodiode signal appears as the only negative voltage signal in the circuit, and the equivalent resistance feedback network is redundantly designed, thus ensuring that no false flame-on conditions will be detected due to the failure of a single resistive component. Because it does not reside within the flame, the sensor is immune to false flame-off conditions caused by material deposition and corrosion of the sensor.

10 Claims, 5 Drawing Sheets

FAIL SAFE GAS FURNACE OPTICAL FLAME SENSOR USING A TRANSCONDUCTANCE AMPLIFIER AND LOW PHOTODIODE CURRENT

FIELD OF THE INVENTION

The present invention relates generally to flame sensors, and more particularly, to a fail safe gas furnace optical flame sensor that uses a transconductance amplifier with low photodiode current to sense the presence or absence of a gas furnace flame.

BACKGROUND OF THE INVENTION

Residential gas furnace products have means for the detection of combustion during all operating cycles of the system. Fail-safe operation of these detection systems is of paramount importance to safety and system reliability. There can be no condition in which the flame sensing unit, i.e. the photodiode or flame rod, produces a false flame response to the input of the flame sense circuitry. The system controller should know if the flame sensor circuitry has failed in a constant flame-on condition. A no-flame signal to the system controller, when there is a flame, is not a safety problem and therefore is permissible. In addition, the flame sensing system should be reliable over time.

Prior art flame detection systems use either a photosensor or an ion probe to detect the presence of a flame, together with logic circuitry to process and analyze the detector output. Ion probe detectors are placed in contact with the flame, thus being subject to deposition and corrosion that may interfere with their operation. An optical flame sensor, such as a photodiode, is non-intrusive, thus enabling it to view the flame without being subject to these detrimental processes. Deposition by insulating materials produced from high temperature sealants used in gas furnaces is common.

Prior art photodiodes operated in the photoconductive mode operate with reverse bias. In this mode, excessive diode leakage (referred to as "dark current") resulting from, for example, but not limited to, a poor device, or elevated temperature, can cause the circuitry to give a false indication of a flame-on condition. Prior art photodiodes operating in the photovoltaic mode use no external bias across the photodiode, resulting in no dark current, increased sensitivity to low light levels, and slightly lower responsivity at longer wavelengths. However, the photo-generated voltage is a logarithmic function of incident light intensity for open circuit photovoltaic operation. Specifically, due to the logarithmic response, the signal produced by a hot surface ignitor, which is used to ignite the main gas flame, is difficult to discern from the signal produced by the flame.

For example, U.S. Pat. No. 4,322,723 appears to disclose a photosensor to detect the presence of a gas flame, but the logarithmic and transconductance amplifiers disclosed have difficulty discerning between the ignitor signal and flame signal. U.S. Pat. No. 4,039,844 appears to disclose a silicon photodiode connected to an a.c. coupled transconductance amplifier; however, the overall circuit is extremely complex, requires operator gain adjustment and does not appear failsafe. Furthermore, the photodiode requires an undesirably high signal level on the order of 1–500 microamperes, indicating a high level of light intensity.

SUMMARY OF THE INVENTION

The present invention provides for an optical flame sensor comprising a photodiode flame sensor operating in a photovoltaic short circuit mode. The photodiode flame sensor is designed to produce a low output current electrical signal when a flame is detected. A photodiode operating in the photovoltaic short circuit mode connected through a transistor to the transconductance amplifier , includes a feedback network designed to conduct the low output current from the flame sensor causing the transconductance amplifier to output a voltage high signal. A voltage comparator designed to compare the transconductance amplifier voltage high signal with a threshold voltage signal in order to develop a logic level output signal for input to a microprocessor is also included. The comparator provides an output signal, based upon the presence of a gas flame, to the system controller. The system also includes a fail safe test circuit designed to provide a test signal, which to interrupts the low output current from the photodiode flame sensor in order to interrogate the functionality of the flame detector during a test pulse.

The invention may also be viewed as providing a method for detecting the presence of a gas flame. In this regard, the method can be broadly summarized as follows:

A photodiode flame sensor is operated in a photovoltaic short circuit mode in order to produce a low output current electrical signal when a flame is detected. A transconductance amplifier is connected via a transistor to the flame sensor. The transconductance amplifier is designed to output a voltage high signal when a flame is detected by the photodiode flame sensor. A voltage comparator circuit compares the transconductance amplifier voltage high signal with a threshold voltage signal in order to develop a logic level output signal for input to a processor. The processor determines whether a gas flame is present. A test pulse designed to interrupt the low output current from the flame sensor interrogates the functionality of the flame detector both when a flame signal is present and also, not present, in order to verify the operability of the flame sensor.

The invention has numerous advantages, a few of which are delineated hereafter, as merely examples.

An advantage of the fail safe gas furnace optical flame sensor is that an optical flame sensor is non-intrusive enabling it to view the flame without interfering with the combustion process or being subject to detrimental deposition and corrosion.

Another advantage of the present invention is that there is no known false flame-on condition resulting from a single part failure.

Another advantage of the present invention is that the photodiode transconductance amplifier circuit is relatively immune from signals caused by the hot surface ignitor.

Another advantage of the present invention is that the photodiode transconductance amplifier circuit operates over a wide temperature range.

Another advantage of the present invention is that the photodiode signal appears as the only negative voltage in the circuit.

Another advantage of the present invention is that the linear response of the optical signal provides a high signal-to-noise ratio allowing superior discrimination between the hot surface ignitor signal and the flame signal.

Another advantage of the present invention is that test pulses from the system controller continuously interrogate the circuit insuring functionality and preventing a false flame-on condition.

Another advantage of the present invention is that the equivalent resistance feedback network of the transconductance amplifier is redundant in design, thus eliminating the possibility of a false flame failure mode due to the failure of a single resistive component.

Another advantage of the present invention is that a minimal number of circuit components results in a high mean time between failure (MTBF) and improved reliability of the gas furnace.

Another advantage of the present invention is that the flame sensor is not subject to false negative signals due to the deposition of sealant outgassing products.

Another advantage of the present invention is that it is simple in design, reliable in operation, and its design lends itself to economical mass production.

Other objects, features, and advantages of the present invention will become apparent to one with skill in the art upon examination of the following drawings and detailed description. It is intended that all such additional objects, features, and advantages be included herein within the scope of the present invention, as defined in the appended claims.

BRIEF DESCRIPTION OF THE DRAWINGS

The present invention, as defined in the claims, can be better understood with reference to the following drawings. The drawings are not necessarily to scale, emphasis instead being placed on clearly illustrating the principles of the present invention.

DETAILED DESCRIPTION OF THE PREFERRED EMBODIMENT

Figure 1:
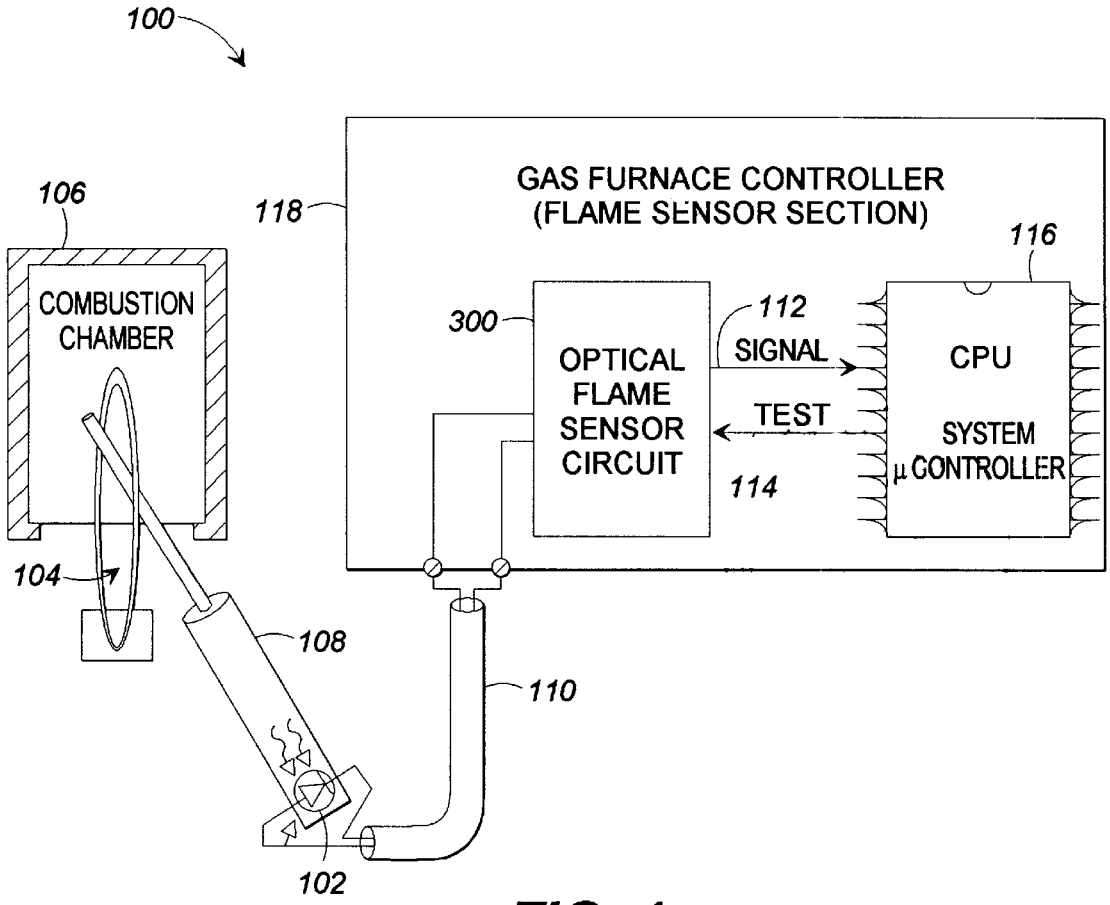
FIG. 1 is a block diagram of the photodiode flame sensing circuit of the present invention.

Referring to FIG. 1, shown is a block diagram of the photodiode flame sensing circuit 100 of the present invention. Photodiode 102 is aimed at flame 104 through view port 108. Photodiode 102 is connected to a remote electronic control module 118 by cable 110. The output of photodiode 102 is supplied via cable 110 to optical flame sensor circuit 300 and will be described in detail hereafter. Also contained within control module 118 is, in the preferred embodiment, a microprocessor-based system controller 116. When a flame is detected, optical flame sensor circuit 300 is configured to provide a logic high level on line 112 to the system controller 116. Periodically, system controller 116 is configured to provide a test signal on line 114 to optical flame sensor circuit 300 to verify circuit integrity, thus preventing a false flame-on decision by system controller 116. The test signal will be described in detail hereafter. The concepts of the present invention may also be practiced using discrete system components, particularly the controller 116.

Figure 2:
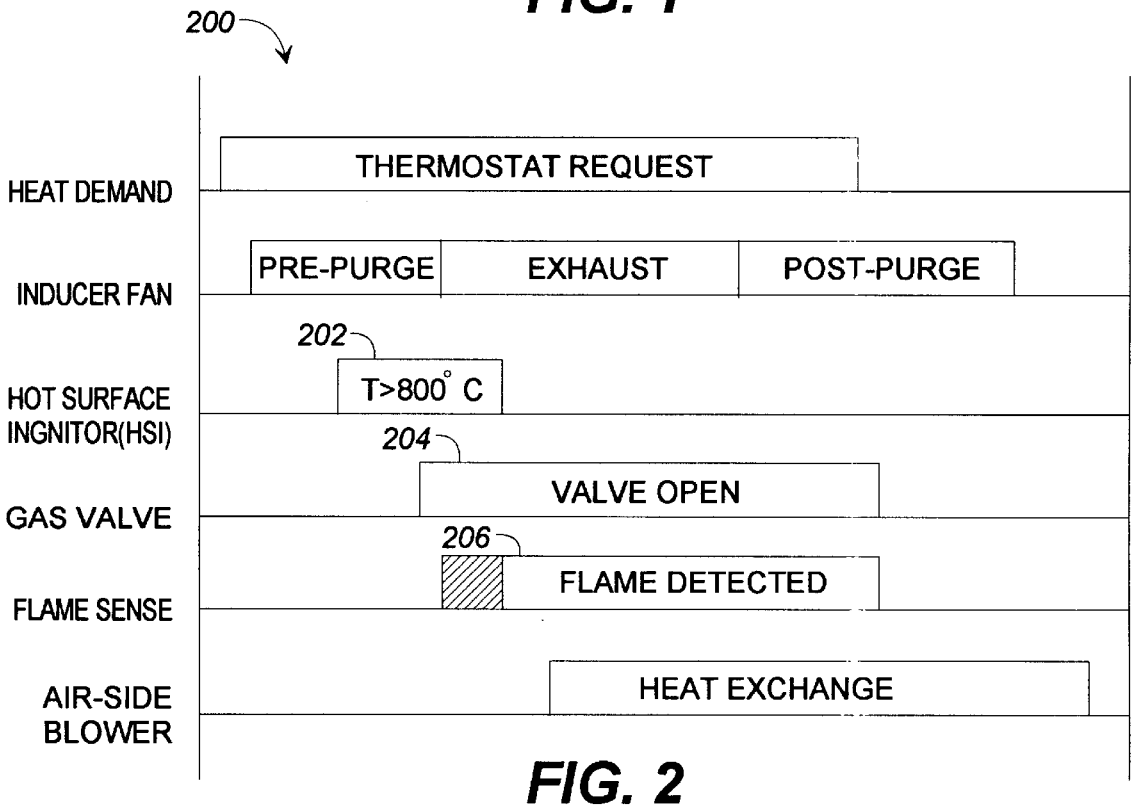
FIG. 2 is a timing diagram of a gas furnace operation cycle.

Referring now to FIG. 2, shown is a timing diagram 200 of a gas furnace operation cycle. A hot surface ignitor 202 is activated prior to the gas valve open signal 204, and deactivated once a flame is detected 206. The hot surface ignitor is a noise source for the photodiode flame sensor circuit, however the circuitry of the present invention is able to discriminate between the signal of the hot surface ignitor and the gas flame.

Figure 3:
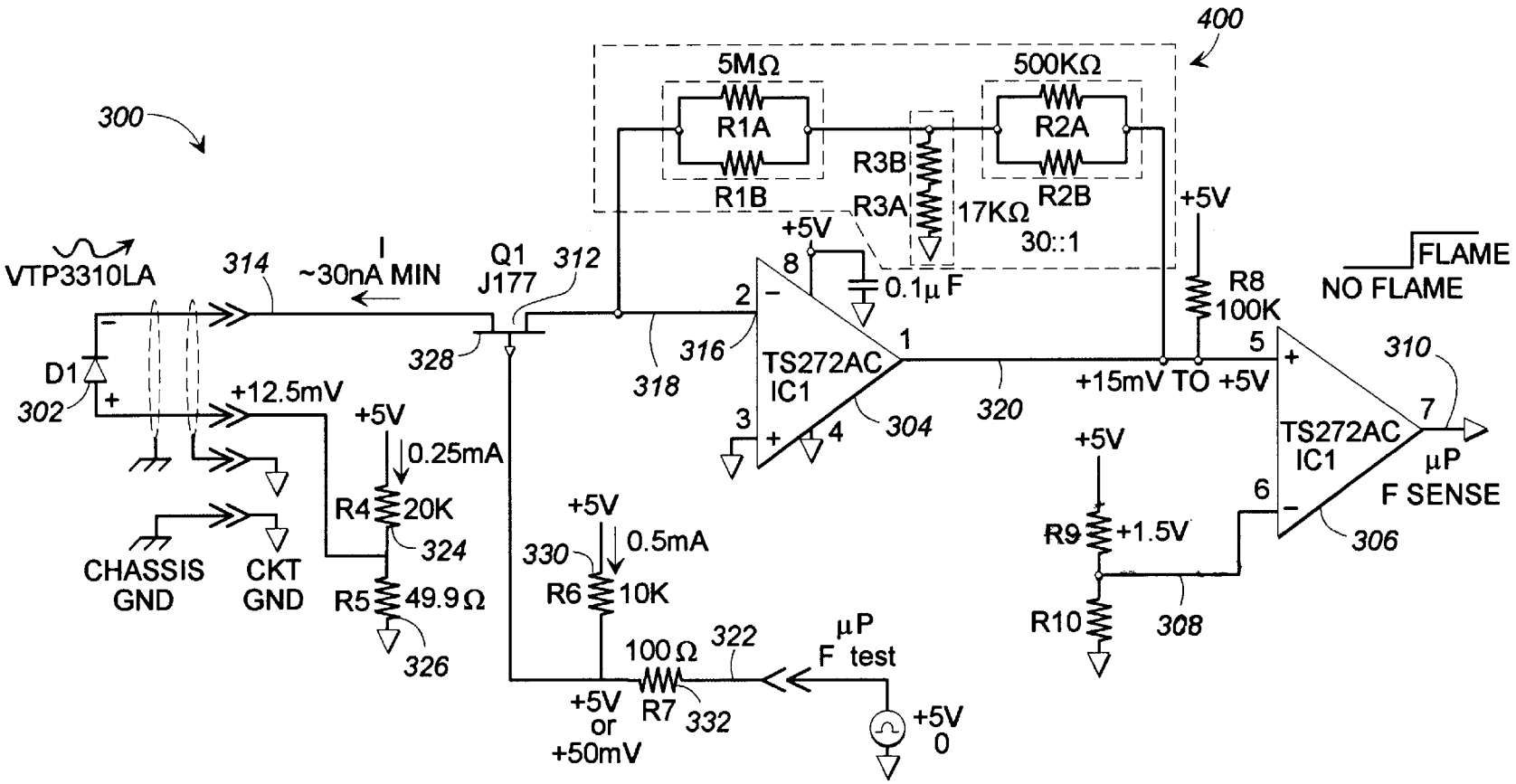
FIG. 3 is a schematic view of the photovoltaic transconductance amplifier circuit of the optical flame sensor circuit of FIG. 1.

Referring now to FIG. 3, shown is a schematic view of the photovoltaic transconductance amplifier circuit 300 of the flame sensor 100 of FIG. 1. In photovoltaic short circuit (transconductance) operation, the resultant voltage on line 320 of amplifier 304 is linearly dependent upon the incident radiation level applied to photodiode 302, resulting in a much lower signal from the hot surface ignitor in comparison to the flame signal produced by the flame. The preferred way to achieve sufficiently low load resistance and an amplified output voltage is by routing the photocurrent on line 314 to an operational amplifier virtual ground. The short circuit current is a linear function of the irradiance over a very wide range of at least seven orders of magnitude, and is only slightly affected by temperature, varying less than 0.2% ° C. for visible wavelength.

Operational amplifier 304 acts as a current-to-voltage converter (transconductance amplifier) with the output signal on line 320 amplified by a large equivalent feedback resistor network 400. A resistor tee circuit can be used as the equivalent feedback resistor network 400, thus limiting the physical on board resistor values. The tee circuit allows using resistor values on the order of 5 MΩ to achieve an equivalent 500 MΩ impedance in the amplifier feedback network. A photodiode operating with a transconductance amplifier eliminates dark current leakage while allowing the amplifier output voltage to remain linearly dependent on the incident radiation level.

Photodiode 302 operates with amplifier 304 in the transconductance mode and provides a low current output, on the order of approximately 30 nanoamperes for the preferred embodiment, on line 314 to transistor 312. Amplifier 306 operates as a comparator in order to compare to output of amplifier 304 with a fixed 1.5 VDC threshold supplied on line 308 to the inverting input of amplifier 306. Amplifier 306 develops a logic level output signal called F Sense on line 310 for delivery to the system controller.

The equivalent circuit of the photodiode appears essentially as a current source shunted by a high value, on the order of about $10^{10}$ ohm, resistor. When transistor 312 is on, light from a gas flame on photodiode 302 causes a signal current to flow out of the virtual ground at amplifier 304 terminal 316 to line 318. This current flows through the equivalent feedback resistance network 400 of amplifier 304, causing amplifier 304 to output a voltage high signal on line 320, and amplifier 306 to output a voltage high sense signal on line 310.

Equivalent feedback resistance network 400 is configured redundantly. Values for resistors R1, R2 and R3 are chosen depending on the equivalent feedback resistance desired and will be discussed in detail hereafter. If resistor R1A or R1B fails in an open state, if R2A or R2B fails in an open state, or R3A or R3B fails in a shorted state the gain of amplifier 304 will increase by a factor of two, resulting in a worst case normal operation because comparator 306 threshold is sufficiently high. If R1A or R1B fails in a shorted state, or R2A or R2B fails in a shorted state, or if R3A or R3B fails in an open state, the gain of amplifier 304 is very low and since a flame is not detected, the furnace will be shut down. As can be seen, there are no known false flame on conditions, thus resulting in fail safe operation of the flame detector.

In order to interrogate the functionality of the flame detector, the system controller sends a test signal on line 322 which turns off transistor 312 for 300 μs at a 70 ms rate. Transistor 312 off interrupts the signal current flowing from photodiode 302 on line 318 to amplifier 304 resulting in a no-flame output decision from amplifier 306. Transistor 312 off causes the photodiode 302 current to flow through the diodes internal shunt resistance, in order to develop a negative voltage of approximately 200–300 mV which appears across the photodiode terminals. Internal shunt resistance of photodiode 302 is not shown on FIG. 3, however it is well known to those skilled in the art.

Figure 4A:
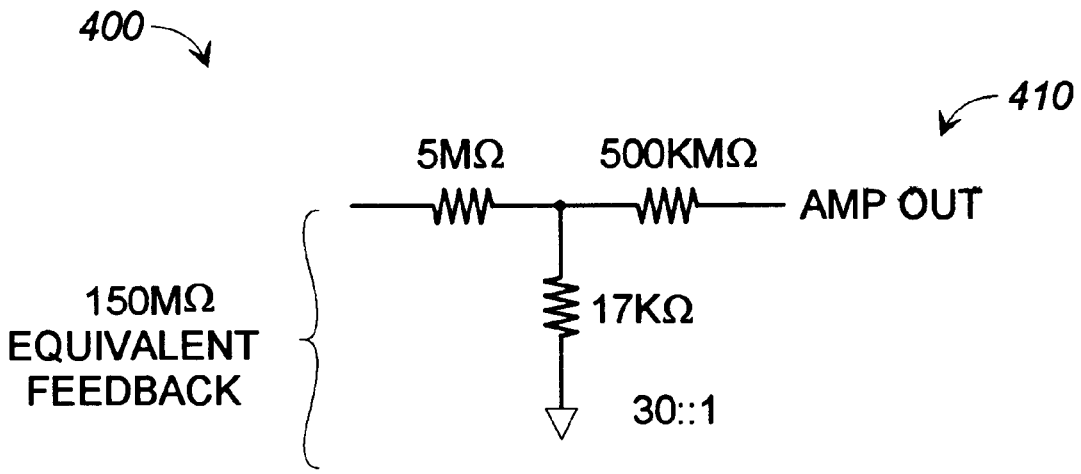
FIGS. 4A and 4B are a schematic view of the equivalent feedback resistance circuit of the amplifier of FIG. 3.
Figure 4B:
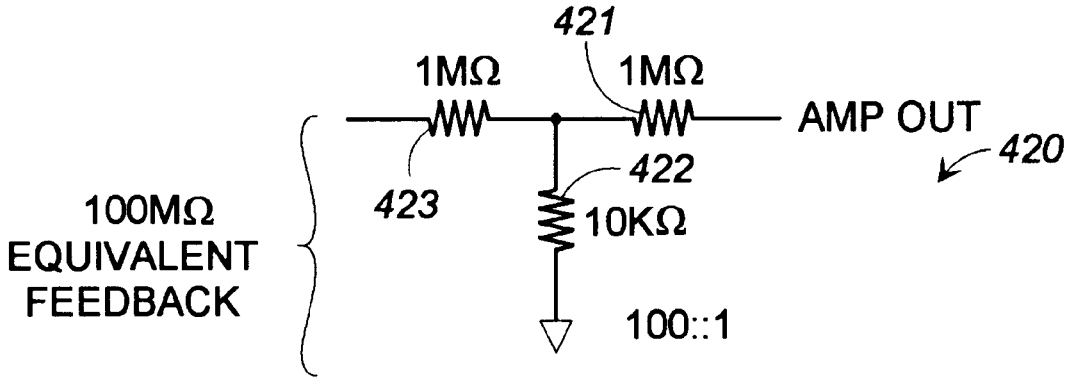

Referring now to FIG. 4, shown is a schematic view of the equivalent feedback resistance circuit 400 of the amplifier of FIG. 3. FIG. 4A shows a resistor network 410 with a 150 MΩ equivalent feedback resistance, while FIG. 4B shows a resistor network 420 with a 100 MΩ equivalent feedback resistance. The values chosen for the preferred embodiment are for illustrative purposes only. Other values are possible depending upon the requirements of each particular application. FIGS. 4A and 4B are shown to illustrate the operation of the equivalent feedback resistance circuit. With reference to FIG. 4B, 1 MΩ resistor 421 and 10 KΩ resistor 422 form approximately a 100::1 voltage divider. The output of amplifier 304 is reduced by a factor of 100 and applied to 1 MΩ resistor 423. This is equivalently a 100 MΩ resistor between amplifier 304 output on line 320, and amplifier 304 negative input 316 on line 318. The operation of the circuit shown in FIG. 4A is similar, providing a 30::1 voltage divider, resulting in a 150 MΩ equivalent feedback resistance.

Figure 5:
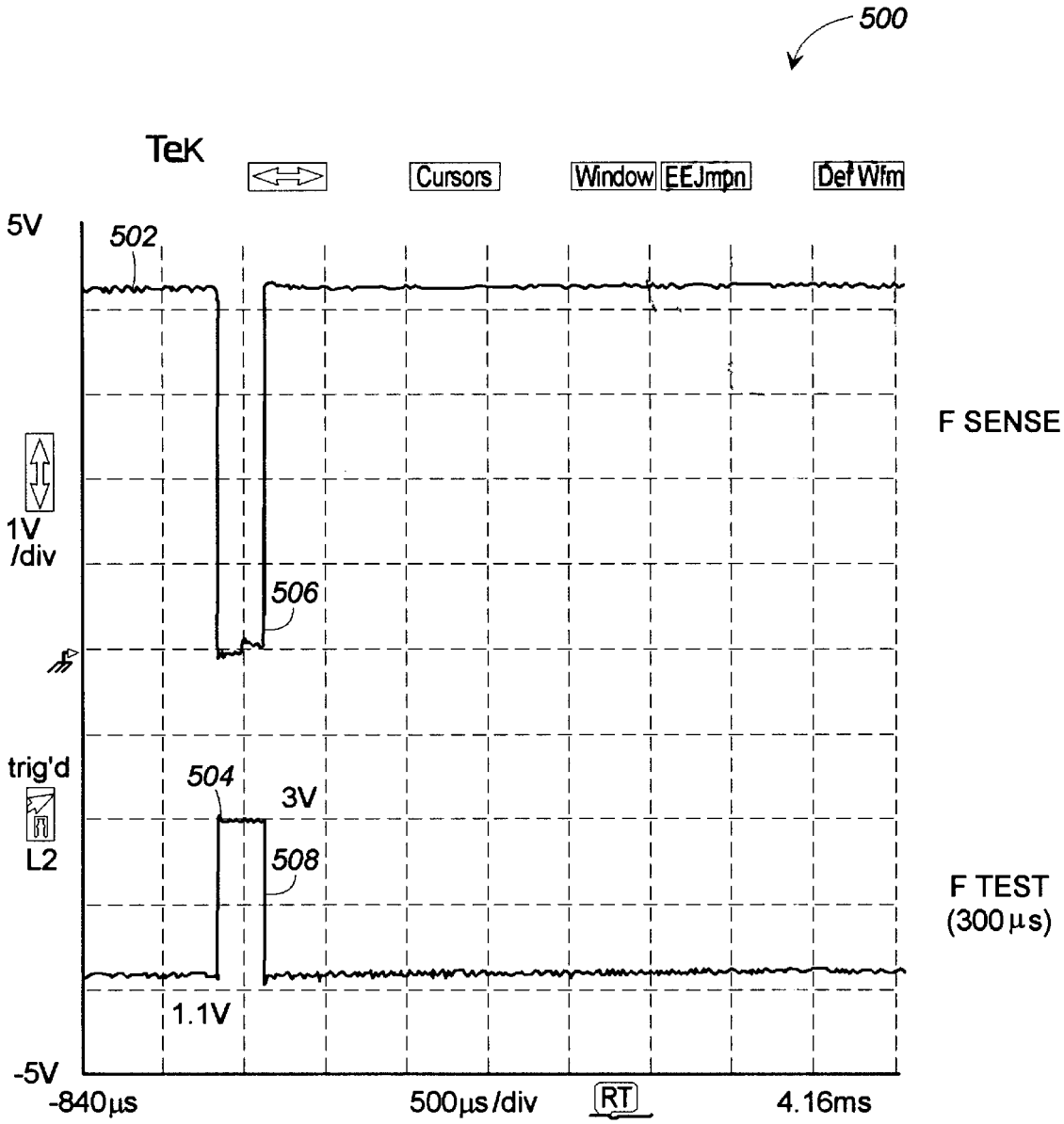
FIG. 5 is a graphical view of an oscilloscope trace illustrating the transconductance amplifier test circuit during a saturated condition.

Referring now to FIG. 5, shown is a graphical view illustrating the transconductance amplifier test circuit during a saturated, or flame on, condition. The sense signal on line 310 of amplifier 306 is at a high (approximately 4.2 VDC) level and is graphically represented by trace 502. During the 300 μs test pulse, depicted by trace 504, the sense signal on line 310 is switched low, as depicted by trace section 506, because Q1 312 has opened the photodiode signal path.

Figure 6:
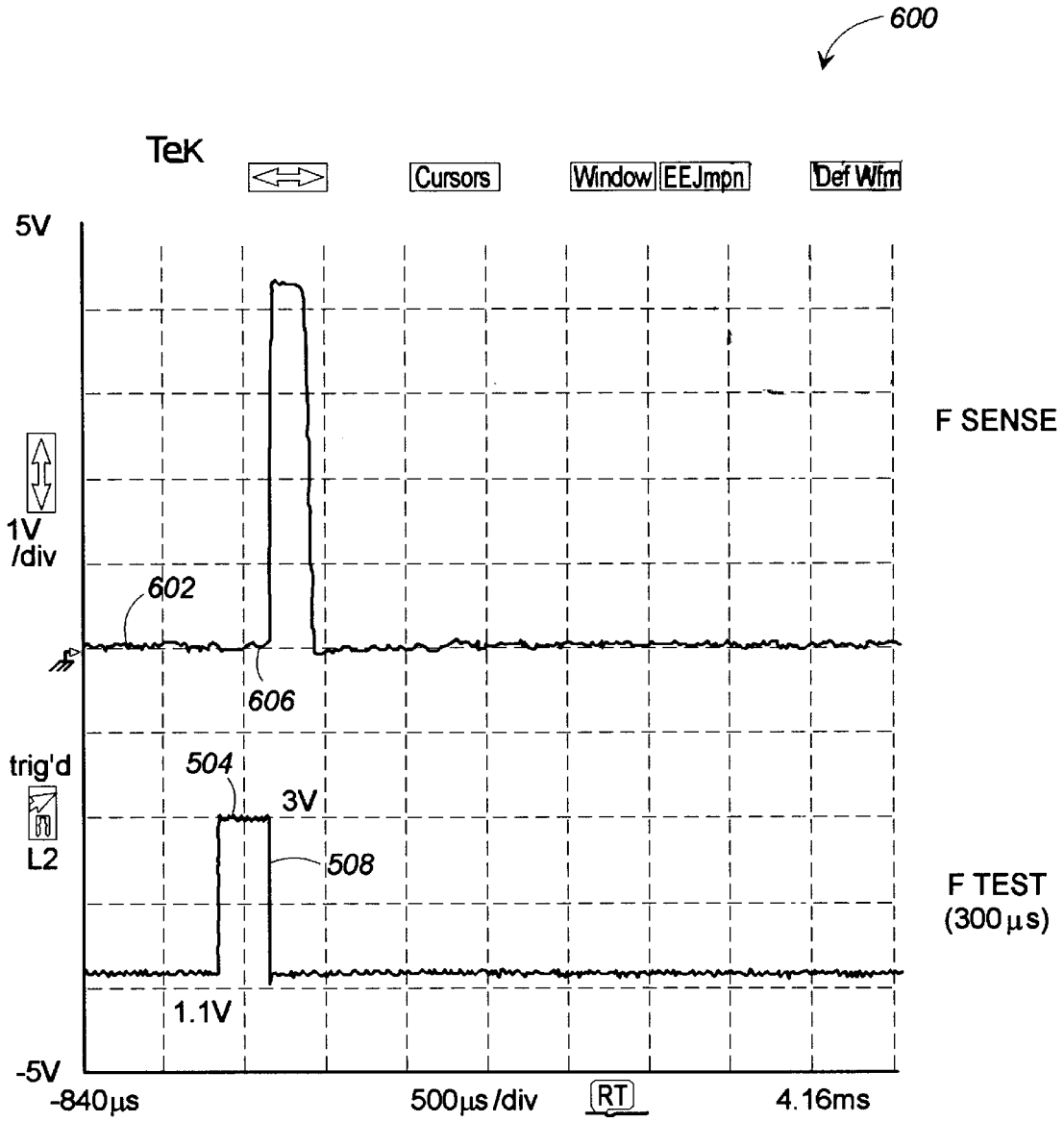
FIG. 6 is a graphical view of an oscilloscope trace illustrating the transconductance amplifier test circuit during a no light condition.

With reference to FIG. 6, shown is a graphical view illustrating the transconductance amplifier test circuit during a no light condition. The sense signal on line 310 of amplifier 306 is at a low (approximately 0 VDC) level because the photodiode signal is absent, and is graphically represented by trace 602. During the 300 μs test pulse, depicted by trace 504, the sense signal remains low, as depicted by trace section 606. The negative excursion of the test pulse, as depicted by trace section 508, capacitively couples a negative pulse current at input 316 of amplifier 304., causing the amplifier to output a logic high on line 320 for input to amplifier 306. This feature enables the test of the flame sensor circuit integrity independent of the flame.

Referring back to FIG. 3, a low level bias is developed by resistors 324 and 326 in order to prevent an erroneous sense decision due to the shorting of photodiode 302, or its conductors, and the input offset voltage of amplifier 304. Similarly, a low level bias is developed by resistors 330 and 332 in order to prevent an erroneous sense decision due to the gate to drain short of transistor 312 and the input offset voltage of amplifier 304.

It will be obvious to those skilled in the art that many modifications and variations may be made to the preferred embodiments of the present invention, as set forth above, without departing substantially from the principles of the present invention. For example, but not limited to the following, it is possible to implement the present invention using discrete components, or to incorporate the functionality onto a single processor such as a digital signal processor. All such modifications and variations are intended to be included herein within the scope of the present invention, as defined in the claims that follow.

In the claims set forth hereinafter, the structures, materials, acts, and equivalents of all "means" elements and "logic" elements are intended to include any structures, materials, or acts for performing the functions specified in connection with said elements.

Therefore, the following is claimed:

1. An optical flame sensor, comprising:

a photodiode flame sensor operating in a photovoltaic short circuit mode designed to produce a low output current electrical signal when a flame is detected;

a transconductance amplifier operating in said photovoltaic short circuit mode connected via a transistor to said flame sensor, said transconductance amplifier including a feedback network designed to conduct said low output current from said flame sensor causing said transconductance amplifier to output a voltage high signal;

voltage comparator circuitry designed to compare said transconductance amplifier voltage high signal with a threshold voltage signal in order to develop a logic level output signal for input to a processor, and test circuitry designed to provide a test signal, said test signal designed to interrupt said low output current from said flame sensor in order to interrogate the functionality of said flame sensor during a test pulse.

2. The flame sensor according to claim 1, wherein said processor contains logic designed to determine whether said flame sensor is detecting a flame.

3. The flame sensor according to claim 1, wherein said test signal is applied during an operating condition when said voltage high signal is present, said test signal causing said voltage high signal to be switched low during a test pulse.

4. The flame sensor according to claim 1, wherein said test signal is applied during a no light test condition when said voltage high signal is absent, said test signal causing the capacitive coupling of negative test pulse current at said transconductance amplifier input, causing said transconductance amplifier output to go into a high state, allowing the testing of said flame sensor in the absence of a flame.

5. The flame sensor according to claim 1, wherein said transconductance amplifier feedback network comprises a redundant tee circuit that allows a large equivalent impedance while using low value resistive components.

6. A method for detecting the presence of a gas flame, comprising the steps of:

operating a photodiode flame sensor in a photovoltaic short circuit mode in order to produce a low output current electrical signal when a flame is detected;

operating a transconductance amplifier that is connected via a transistor to said flame sensor in said photovoltaic short circuit mode, said transconductance amplifier designed to output a voltage high signal when a flame is detected by said photodiode flame sensor;

operating a voltage comparator circuit designed to compare said transconductance amplifier voltage high signal with a threshold voltage signal in order to develop a logic level output signal for input to a processor, and sending a test pulse, said test pulse designed to interrupt said low output current from said flame sensor in order to interrogate the functionality of said flame sensor during a test pulse.

7. The method according to claim 6, wherein said microprocessor contains logic designed to determine whether said flame sensor is detecting a flame.

8. The method according to claim 6, wherein said test signal is applied during an operating condition when said voltage high signal is present, said test signal causing said voltage high signal to be switched low during a test pulse.

9. The method according to claim 6, wherein said test signal is applied during a no light test condition when said voltage high signal is absent, said test signal causing the capacitive coupling of negative test pulse current at said transconductance amplifier input, causing said transconductance amplifier output to go into a high state, allowing the testing of said flame sensor in the absence of a flame.

10. The method according to claim 6, wherein said transconductance amplifier feedback network comprises a redundant tee circuit that allows a large equivalent impedance while using low value resistive components.

* * * * *